US011619451B2

(12) United States Patent
Abdoo et al.

(10) Patent No.: US 11,619,451 B2
(45) Date of Patent: Apr. 4, 2023

(54) OVEN HAVING AN IMAGING DEVICE

(71) Applicant: WHIRLPOOL CORPORATION, Benton Harbor, MI (US)

(72) Inventors: Joshua G. Abdoo, Stevensville, MI (US); Ariana M. Bruno, St. Joseph, MI (US); Neomar Giacomini, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/575,923

(22) Filed: Jan. 14, 2022

(65) Prior Publication Data

US 2022/0136774 A1 May 5, 2022

Related U.S. Application Data

(63) Continuation of application No. 16/729,722, filed on Dec. 30, 2019, now Pat. No. 11,231,230, which is a (Continued)

(51) Int. Cl.

| | |
|---|---|
| ***F27D 21/02*** | (2006.01) |
| ***F24C 15/34*** | (2006.01) |
| ***F24C 15/00*** | (2006.01) |

(52) U.S. Cl.

CPC ..... *F27D 21/02* (2013.01); *F24C 15/008* (2013.01); *F24C 15/34* (2013.01); *F27D 2021/026* (2013.01)

(58) Field of Classification Search

CPC ..... F24C 15/008; F24C 15/34; F27D 21/02; F27D 2021/026

(Continued)

(56) References Cited

U.S. PATENT DOCUMENTS 9,149,058 B2 * 10/2015 Bilet ..... A47J 27/16
9,412,030 B2 * 8/2016 Bocharov ..... G06T 5/001

(Continued)

FOREIGN PATENT DOCUMENTS

BE 1020505 A3 11/2013
CN 103134090 A * 6/2013

(Continued)

OTHER PUBLICATIONS

JP 2003274235 A Translation (Year: 2003).*

(Continued)

*Primary Examiner* — Steven B McAllister
*Assistant Examiner* — Benjamin W Johnson
(74) *Attorney, Agent, or Firm* — McGarry Bair PC

(57) ABSTRACT

An oven can include an oven body including a set of interior panels. A set of exterior panels are spaced from the set of interior panels such that a channel is defined between the set of interior panels and the set of exterior panels. The set of interior panels includes an interior panel peripheral wall and an interior panel top wall that at least partially define a cooking cavity. Each interior panel of the set of interior panels has an inner surface and an outer surface. The oven further includes an imaging device with a field of view including at least a portion of the cooking cavity. The oven also comprises a damper coupled to the oven body and to the imaging device for absorbing mechanical vibrations associated with airflow generated by the fan.

18 Claims, 4 Drawing Sheets

Related U.S. Application Data continuation of application No. 15/795,597, filed on Oct. 27, 2017, now Pat. No. 10,591,218.

(58) Field of Classification Search
USPC ..... 432/32
See application file for complete search history.

(56) References Cited

U.S. PATENT DOCUMENTS

| | | | | |
|---|---|---|---|---|
| 9,644,847 | B2 | 5/2017 | Bhogal et al. | |
| 2015/0056344 | A1 | 2/2015 | Luckhardt | |
| 2015/0136760 | A1 | 5/2015 | Lima et al. | |
| 2016/0348918 | A1 | 12/2016 | Bhogal et al. | |
| 2017/0115008 | A1 | 4/2017 | Erbe et al. | |
| 2017/0170978 | A1* | 6/2017 | Luckhardt | H04L 65/612 |
| 2018/0058702 | A1* | 3/2018 | Jang | F24C 15/006 |

FOREIGN PATENT DOCUMENTS

| | | | | |
|---|---|---|---|---|
| CN | 103134090 | A | | 6/2013 |
| CN | 205410942 | U | | 8/2016 |
| DE | 102008043722 | A1 | | 5/2010 |
| EP | 2520169 | A1 | | 11/2012 |
| EP | 1601236 | A2 | | 11/2015 |
| JP | 2003274235 | A | * | 9/2003 |
| JP | 2003274235 | A | | 9/2003 |
| WO | 2016196669 | A1 | | 12/2016 |

OTHER PUBLICATIONS

CN 103134090 A Translation (Year: 2013).*
European Search Report for Counterpart EP182029991, dated Mar. 19, 2019.

* cited by examiner

OVEN HAVING AN IMAGING DEVICE

CROSS REFERENCE TO RELATED APPLICATIONS

This application is a continuation application of U.S. patent application Ser. No. 16/729,722, filed Dec. 30, 2019, now U.S. Pat. No. 11,231,230, issued Jan. 25 2022, which is a continuation application of U.S. patent application Ser. No. 15/795,597, filed Oct. 27, 2017, now U.S. Pat. No. 10,591, 218, issued Mar. 17, 2020, both of which are incorporated herein by reference in their entirety.

BACKGROUND

A kitchen appliance, such as an oven, can include a cooking cavity where contents to be cooked are placed for cooking by a user. Typically, the user desires to monitor the progress of the contents while being cooked. Historically, ovens and other cooking appliances include doors providing access to the cooking cavity having transparent windows and a light within the cooking cavity to illuminate the contents in order to monitor the progress of the contents being cooked through the window. However, the windows on the door only provide one view of the contents to be cooked. Often times, a user will need to open the door and pull out the contents to be cooked in order to view the top or another side of the contents to be cooked that is not visible through the window. Opening the door can cause a drop in temperature of the oven and can affect cooking time and quality of the contents to be cooked.

BRIEF DESCRIPTION

In one aspect, the present disclosure relates to an oven comprising an oven body having a set of interior panels and a set of exterior panels that are spaced from the set of interior panels such that a channel is defined between the set of interior panels and the set of exterior panels, wherein the set of interior panels comprises an interior panel peripheral wall and an interior panel top wall that at least partially define a cooking cavity. Each interior panel of the set of interior panels has an inner surface and an outer surface. The oven further comprises an imaging device provided on the outer surface of the interior panel top wall and mounted in the channel with a field of view including at least a portion of the cooking cavity. The oven also has a fan located within the channel and generating a cooling airflow through a portion of the channel. The fan is fluidly coupled to the imaging device to direct the cooling airflow over the imaging device. The oven also comprises a damper coupled to the oven body and to the imaging device for absorbing mechanical vibrations associated with airflow generated by the fan.

DETAILED DESCRIPTION

An oven can include a camera housed within walls of a cooking cavity with a field of view that passes through at least a portion of the cooking cavity. Contents to be cooked are located within the cooking cavity such that the camera can image the contents. A thermal management system can be provided to insulate, cool and otherwise protect the camera from the heat of the oven cavity during operation.

Figure 1:
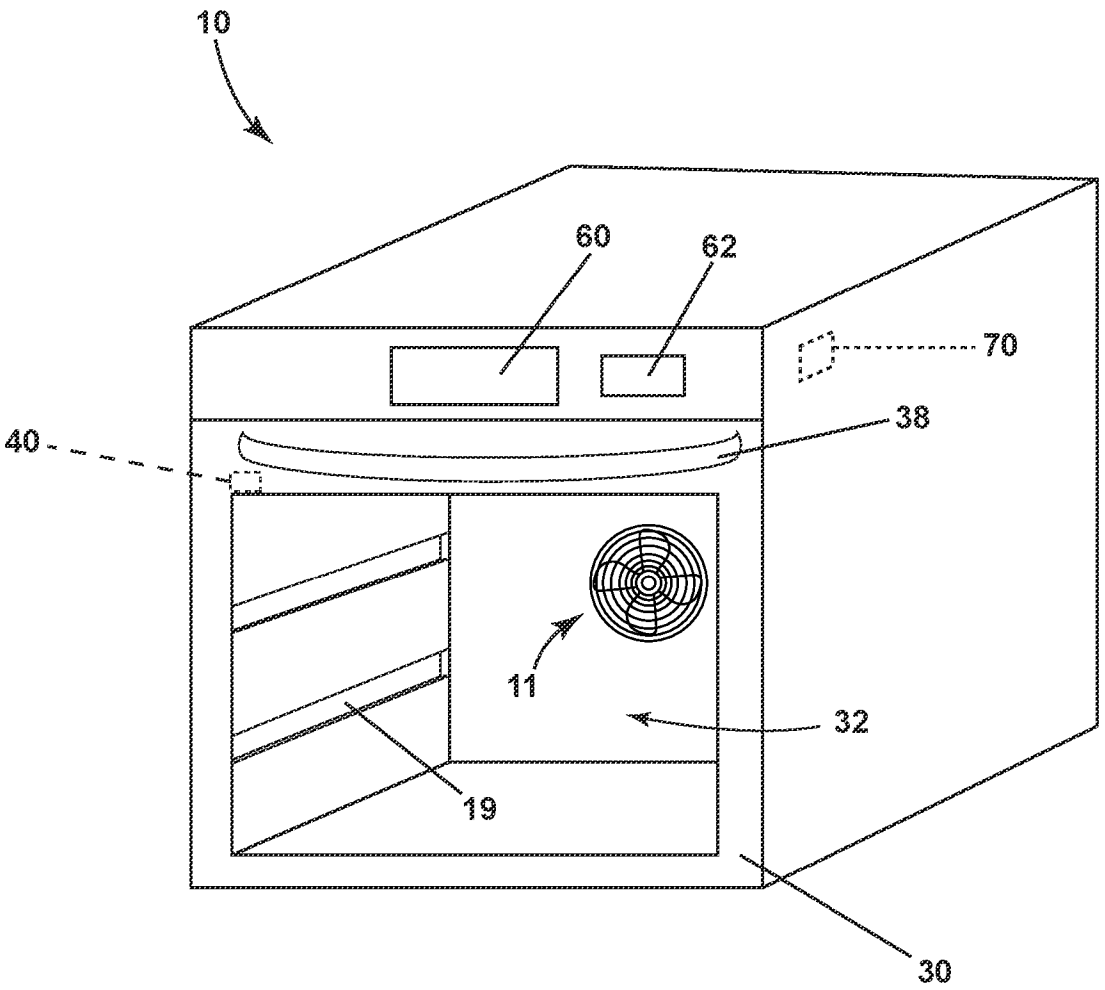
FIG. 1 is a perspective view of an oven according to aspects described herein.

FIG. 1 is a perspective view of an oven 10. The oven 10 described herein shares many features of a traditional oven, which will not be described in detail except as necessary for a complete understanding of the present disclosure. While the aspects of the present disclosure are described in the context of an oven 10, the aspects of the present disclosure may be used with any type of cooking appliance, non-limiting examples of which include a convection oven, a steam oven, a toaster oven, and a microwave.

As illustrated in FIG. 1, the oven 10 can include a door 30 having a handle 38 and is moveable between open and closed positions. As illustrated, the door 30 is in the closed position. The door 30 can form part of a cooking cavity 32 when the door 30 is in the closed position. The cooking cavity 32 can include a fan 11 and rack mounts 19 configured to hold rack inserts (not shown) such that contents to be cooked within the cooking cavity 32 can be placed on the racks inserts.

The oven 10 can include an imaging device 40 for imaging the contents to be cooked. The imaging device 40 can be in the form of a camera 40, or any other suitable imaging device 40. A display 60 such as an LCD screen 60, can be provided on the oven 10 and can be in communication with the camera 40 where the LCD screen 60 can display images captured by the camera 40. The image output by the camera 40 can be a real-time representation of the contents being cooked to allow a user to monitor the contents using the LCD screen 60 without the need for opening the door 30. Furthermore, the oven 10 can include a user interface 62. The user interface 62 can include operational controls such as dials, lights, knobs, levers, buttons, switches, and displays enabling the user to input commands to a controller 70 to operate the oven 10 and to receive information about an operational status of the oven 10. While the LCD screen 60 and the user interface 62 are shown as separate components, it is possible that the LCD screen 60 and the user interface 62 are combined into one component.

Figure 2:
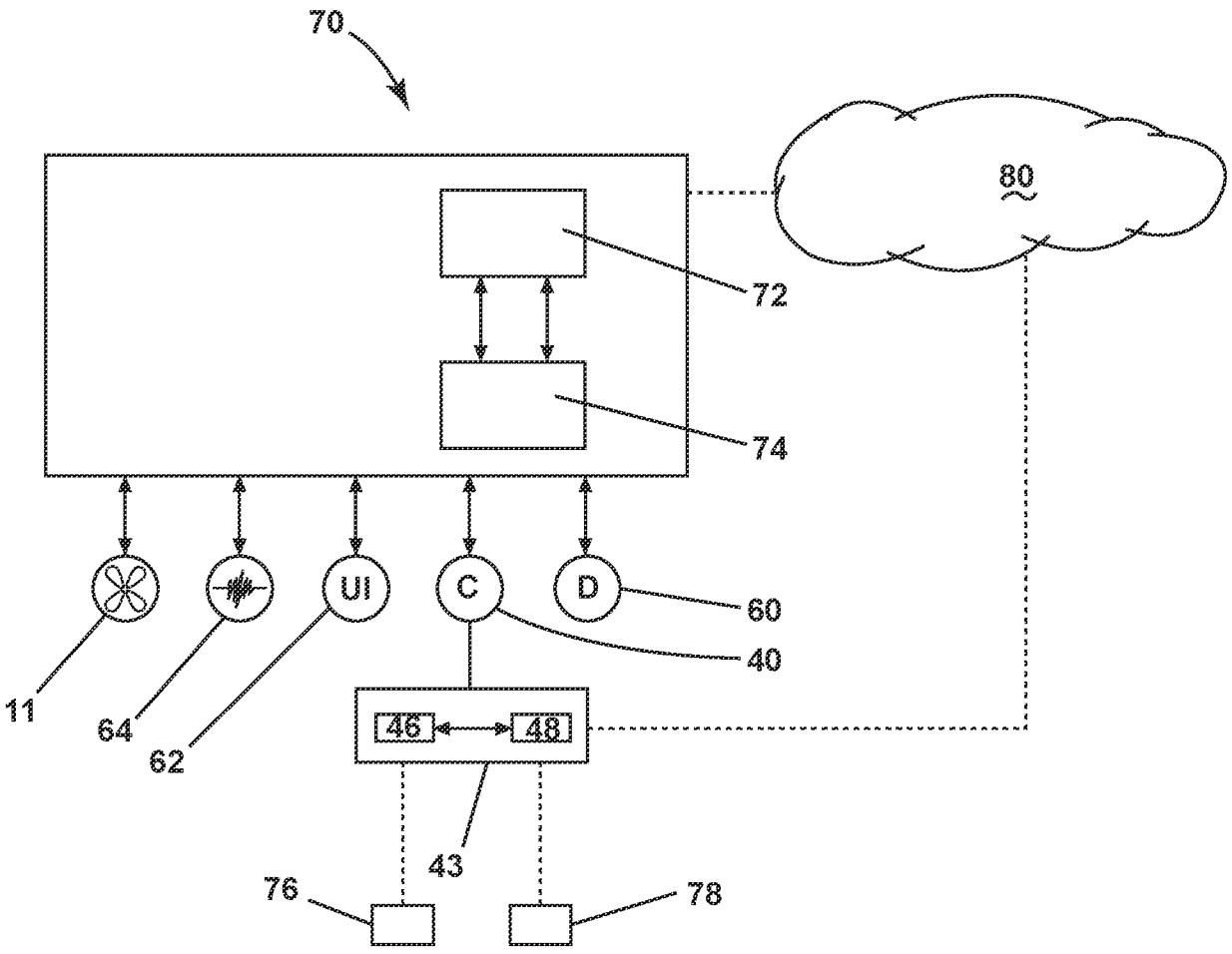
FIG. 2 is a schematic view of a controller according to aspects described herein.

FIG. 2 is a schematic view of the controller 70 coupled to the various components of the oven 10. The controller 70 may be communicably coupled to components of the oven 10 such as a heating element 64, the fan 11, the user interface 62, the camera 40, and the display 60 to either control these components and/or receive their input for use in controlling the components.

The controller 70 can implement a heating cycle selected by the user according to any options selected by the user and provide related information to the user. The controller 70 can also include a central processing unit (CPU) 74 and an associated memory 72 where various operational procedures may be stored. One or more software applications, such as an arrangement of executable commands/instructions may be stored in the memory 72 and executed by the CPU 74 to implement the operational procedures. The controller 70 can be in communication with the camera 40 such that the images can be output by the camera 40 and input to the controller 70. The controller 70 can output the images to the display 60 or another display, such as a mobile device display in order for a user to remotely monitor the contents being cooked.

The camera 40 can also include a controller 43 that can include a CPU 46 and an associated memory 48. The controller 43 or the controller 70 can be in communication with a network 80, such as the internet. The network 80 can include wired, wireless, or a combination of wired and wireless points or nodes to connect communication paths for exchanging and transporting data. Thus, the images from the camera 40 can be sent to a mobile device via the network 80 from either controller 43 or 70. The camera 40 can be directly coupled to the controller 70 or indirectly coupled to the controller 70 via the network 80.

The camera 40 can include an image recognition algorithm 76 that can be implemented as a program in the controller 43 wherein blurry images taken by the camera 40 are detected. The image recognition algorithm 76 can also decide to discard blurry images such that the blurry images are not output by the camera 40. Furthermore, the camera 40 can include a deblurring image algorithm 78 that can also be implemented as a program in the controller 43. The deblurring image algorithm 78 can correct blurry images detected by the image recognition algorithm 76. The deblurring image algorithm 78 can also be implemented in a cloud in the network 80, wherein the network 80 can communicate output from the deblurring image algorithm 78 to the controller 70.

Figure 3:
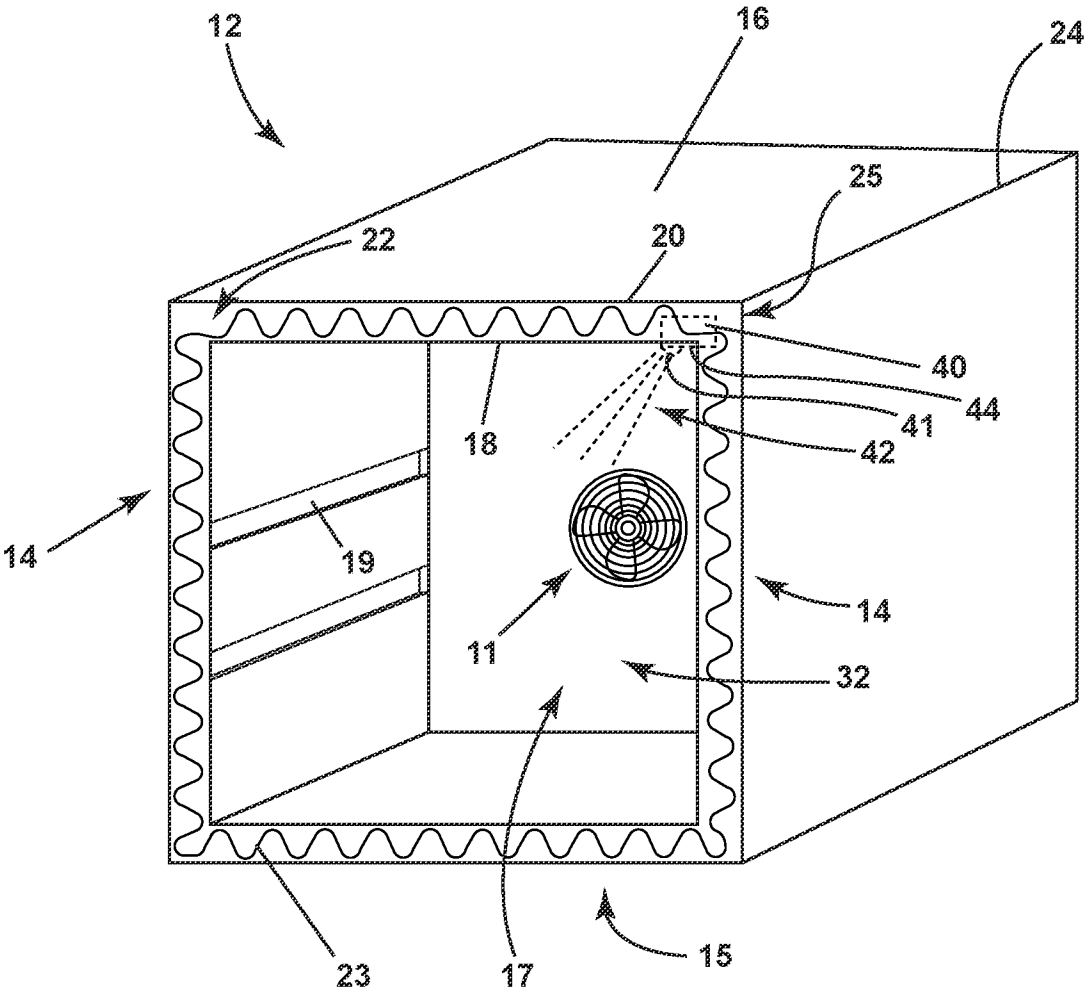
FIG. 3 is a perspective view of an exemplary oven cooking cavity according to aspects described herein.

Turning to FIG. 3, an oven body 12 of the oven 10 in FIG. 1 is illustrated. The oven body 12 can include a pair of peripheral walls 14, a top wall 16, and a bottom wall 15. A rear wall 17 can couple the peripheral walls 14, the top wall 16, and the bottom wall 15 and partially define the cooking cavity 32. An inner top edge 24 can be defined where the top wall 16 meets either of the peripheral walls 14. The top wall 16, the peripheral walls 14, and the bottom wall 15 can include an interior panel 18 spaced from an exterior panel 20. The panels 18, 20 can be made of any suitable material, such as metal, to withstand heat from the cooking cavity 32.

A channel 22 can be defined by the space between the interior panel 18 and the exterior panel 20 and can include insulation 23 located within the channel 22. The insulation 23 can be provided to insulate the cooking cavity 32 to prevent loss of heat for more efficient cooking.

The camera 40 can be mounted within the channel 22 and can be in thermal engagement with the insulation 23 to help keep the camera 40 insulated from oven heat when in operation. The camera 40 can be embedded within the insulation 23 and can be positioned such that the camera 40 having a lens 41 has a field of view 42 directed into the cooking cavity 32 including at least a portion of the cooking cavity 32. As illustrated in FIG. 3, the camera 40 can be mounted in the upper front corner 25 of the oven cavity or in nearly any location along the inner top edge 24. The camera 40 can include a stand or feet to create a space between the camera 40 and the interior panel 18, such that the camera 40 is raised and does not rest directly on the interior panel 18.

In order for the field of view 42 to pass into the cooking cavity 32, the interior panel 18 can include an aperture 44. The aperture 44 can include a clear cover, which can be in the form of glass, or any other suitable transparent material to enable the field of view 42 to pass into the cooking cavity 32 and to seal the space in the interior panel 18 formed by the aperture 44. The cover can include a single layer of glass or multiple layers of glass where the cover is disposed between the interior panel 18 and the camera 40. A single or multiple layers of glass can provide additional insulation for the camera 40 and lens 41.

Furthermore, the camera 40 can include a damper coupled with the oven body 12 to control and absorb mechanical vibrations in the oven 10. The damper can be in the form of a heat resistant rubber or foam that can be disposed around the entire camera 40 or a portion of the camera 40. Mechanical vibrations can include vibrations from a fan, such as the fan 11, or airflow within the channel 22 that comes into contact with the camera 40. In the case that the oven 10 includes a range or cook top above the oven 10, vibrations to the oven 10 can result from boiling water on the range, a user moving around pots, pans, or utensils, and the like.

Figure 4:
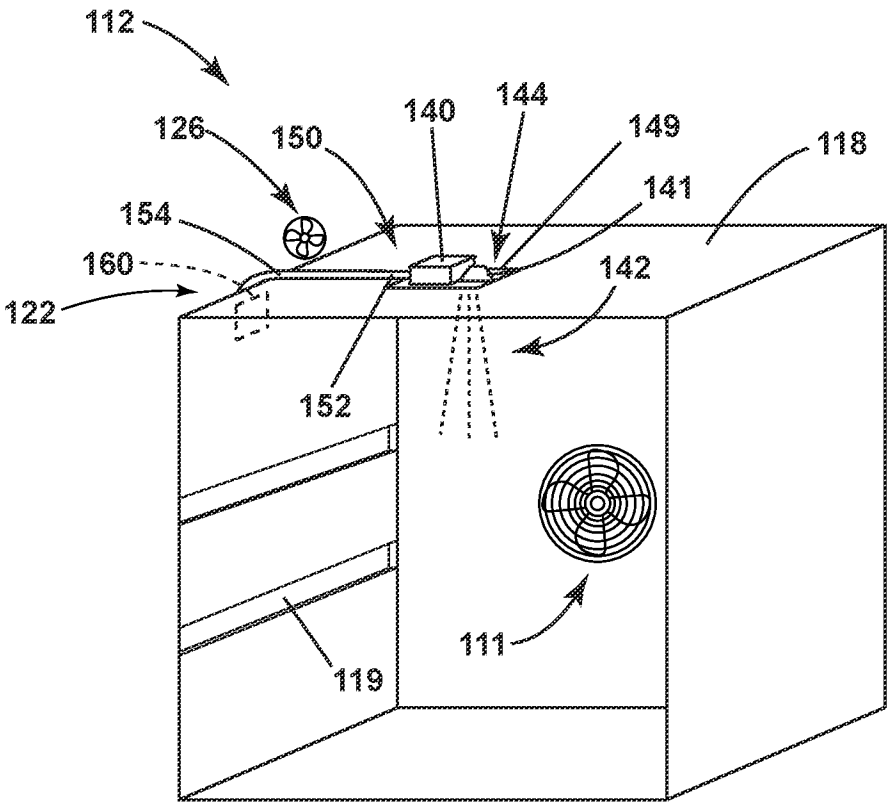
FIG. 4 is a perspective view of another exemplary oven cooking cavity without an exterior panel according to aspects described herein.

Turning to FIG. 4, another exemplary oven body 112 is shown in more detail. Since the oven body 112 is similar to the oven body 12; like parts will be identified with like numerals increased by 100, with it being understood that the description of the like parts of oven body 12 applies to oven body 112, unless otherwise noted. In FIG. 4 the exterior panel and the insulation are not shown to more clearly illustrate the camera 140.

While FIG. 3 illustrates the camera 40 in the upper front corner 25 or inner top edge 24 of the oven body 12, the camera 140 can also be mounted in a middle portion of the inner panel 118. The camera 140 can be coupled to a heat sink 160 in order to dissipate heat from within the channel 122 away from the camera 140. The heat sink 160 can be thermally or mechanically coupled to the camera 140 such that the heat sink 160 is indirectly or directly coupled to the camera 140. In one example, the heat sink 160 can include a heat pipe 150 having a first end 152 coupled to the camera 140 and a second end 154 spaced from the first end 152 and coupled to the heat sink 160. Additionally, FIG. 4 more clearly illustrates the aperture 144 and the clear cover 149.

An auxiliary fan 126 can be coupled with the oven body 112 and included within the channel 122 in order to direct airflow towards the camera 140 and provide a cooling effect on the camera 140. While it is contemplated the fan 126 can be directed toward the camera 140, the fan 126 can be also be directed toward the heat sink 160 to help further dissipate heat.

The aspects of the disclosure described herein can be used to monitor contents to be cooked during cooking in an oven without the need for opening the oven door to view additional angles of the contents to be cooked. Aspects of the disclosure can improve imaging of an oven cavity by managing heat and vibrations on the camera. The upper corner, or top edge of the oven body can be considered a cooler location for the camera. Additionally, heat sinks can be used to aid in the dissipation of heat from the camera. Furthermore, aspects described herein can be used to display images of the contents to be cooked that are not blurred in order for a user to view clear images for monitoring the contents to be cooked.

To the extent not already described, the different features and structures of the various aspects can be used in combination with each other as desired. That one feature may not be illustrated in all of the aspects is not meant to be construed that it may not be, but is done for brevity of description. Thus, the various features of the different aspects can be mixed and matched as desired to form new aspects, whether or not the new aspects are expressly described. All combinations or permutations of features described herein are covered by this disclosure. For example, while only shown in FIG. 4, the oven body 12 in FIG. 3 can include an aperture for the camera 40. It should be appreciated that the aforementioned method can be used within alternative appliances.

This written description uses examples to disclose the present disclosure, including the best mode, and to enable any person skilled in the art to practice the aspects of the present disclosure, including making and using any devices or systems and performing any incorporated methods. The patentable scope of the present disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An oven, comprising:

an oven body comprising a set of interior panels and a set of exterior panels that are spaced from the set of interior panels such that a channel is defined between the set of interior panels and the set of exterior panels, wherein the set of interior panels comprises an interior panel peripheral wall and an interior panel top wall that at least partially define a cooking cavity, and wherein each interior panel of the set of interior panels has an inner surface and an outer surface;

an imaging device provided on the outer surface of the interior panel top wall and mounted in the channel with a field of view including at least a portion of the cooking cavity;

a heat sink provided on the outer surface of the interior panel peripheral wall;

a heat pipe thermally coupling the heat sink with the imaging device and having a first end coupled to the imaging device and a second end, spaced from the first end, that is coupled to the heat sink;

a fan located within the channel and generating a cooling airflow through a portion of the channel, wherein the fan directs the cooling airflow over the imaging device; and a damper coupled to the oven body and to the imaging device for absorbing mechanical vibrations associated with airflow generated by the fan.

2. The oven of claim 1 wherein the fan directs cooling airflow to one of the imaging device or the heat sink.

3. The oven of claim 1 wherein the fan is mounted on the outer surface of one of the interior panels.

4. The oven of claim 1 further comprising insulation located in at least a portion of the channel.

5. The oven of claim 4 wherein the imaging device is in thermal engagement with the insulation.

6. The oven of claim 1 wherein the first end of the heat pipe is disposed along the outer surface of the interior panel top wall and the second end of the heat pipe is disposed along the outer surface of the interior panel peripheral wall.

7. The oven of claim 1 wherein the oven body defines an inner top edge where the interior panel top wall meets the interior panel peripheral wall, wherein the imaging device is mounted on the outer surface of the interior panel top wall along the inner top edge.

8. The oven of claim 1 further comprising an aperture in one of the interior panels, through which the field of view of the imaging device passes, and a clear cover for the aperture.

9. The oven of claim 8 wherein the clear cover is glass, the glass comprising multiple layers of glass disposed between the one of the interior panels and the imaging device.

10. The oven of claim 1 wherein the damper is one of foam or rubber.

11. The oven of claim 1 wherein the damper is disposed around an entirety of the imaging device.

12. The oven of claim 1 further comprising a door having an open position and a closed position, wherein in the closed position the door forms part of the cooking cavity.

13. The oven of claim 1 wherein the oven further comprises an LCD screen or a user mobile device in communication with the imaging device.

14. The oven of claim 13 wherein at least one of the imaging device or a cloud in a network comprises an image recognition algorithm for detecting blurry images and a deblurring image algorithm for correcting the blurry images.

15. The oven of claim 14 wherein the imaging device or the cloud in the network transmits images to the LCD screen or the user mobile device.

16. The oven of claim 1 further comprising a controller in communication with the imaging device and further in communication with one of an LCD screen on the oven or a user mobile device, wherein the controller transmits images to the LCD screen or the user mobile device.

17. The oven of claim 1 wherein the heat sink is provided within the channel and external to the cooking cavity.

18. The oven of claim 1 wherein the outer surface of each interior panel is external to the cooking cavity.

* * * * *